US012209841B2

(12) United States Patent
Ball et al.

(10) Patent No.: US 12,209,841 B2
(45) Date of Patent: Jan. 28, 2025

(54) FIREARM ACCESSORY

(71) Applicant: Crimson Trace Corporation, Columbia, MO (US)

(72) Inventors: Shane Ball, Columbia, MO (US); William Garland, Columbia, MO (US); William A. Planck, Columbia, MO (US); Tim Meissen, Columbia, MO (US); Michael Cottrell, Ashland, MO (US); James Tayon, Moberly, MO (US); Ryan Donahue, Columbia, MO (US); John Oller, Columbia, MO (US); Curtis Smith, Columbia, MO (US)

(73) Assignee: Crimson Trace Corporation, Columbia, MO (US)

( * ) Notice: Subject to any disclaimer, the term of this patent is extended or adjusted under 35 U.S.C. 154(b) by 0 days.

(21) Appl. No.: 17/730,180

(22) Filed: Apr. 26, 2022

(65) Prior Publication Data

US 2022/0341703 A1 Oct. 27, 2022

Related U.S. Application Data

(60) Provisional application No. 63/179,842, filed on Apr. 26, 2021.

(51) Int. Cl.

| | |
|---|---|
| ***F41G 1/35*** | (2006.01) |
| ***F41A 9/72*** | (2006.01) |
| ***F41C 27/00*** | (2006.01) |

(52) U.S. Cl.

CPC ..... *F41C 27/00* (2013.01); *F41A 9/72* (2013.01); *F41G 1/35* (2013.01)

(58) Field of Classification Search

CPC ..... F41G 1/35; F41A 9/72; F41C 27/00
USPC ..... 42/90
See application file for complete search history.

(56) References Cited

U.S. PATENT DOCUMENTS

| | | | | |
|---|---|---|---|---|
| 3,513,581 | A | 5/1970 | Slater | |
| 4,777,754 | A | 10/1988 | Reynolds, Jr. | |
| 4,856,218 | A | 8/1989 | Reynolds, Jr. | |
| 5,237,773 | A | 8/1993 | Claridge | |
| 6,565,226 | B1 * | 5/2003 | Cummings | F41G 1/35 362/113 |
| 6,578,311 | B2 | 6/2003 | Danielson et al. | |
| 6,722,076 | B2 | 4/2004 | Nielsen | |
| 7,584,569 | B2 | 9/2009 | Kallio et al. | |
| 8,093,992 | B2 | 1/2012 | Jancic et al. | |
| 8,215,048 | B2 | 7/2012 | Summers | |
| 9,080,833 | B1 | 7/2015 | Williford | |
| 9,080,834 | B1 | 7/2015 | Williford | |
| 9,080,835 | B1 | 7/2015 | Williford | |
| 9,080,836 | B1 | 7/2015 | Williford | |
| 9,175,924 | B1 * | 11/2015 | Williford | F41G 1/345 |
| 9,658,029 | B1 | 5/2017 | Williford | |
| 9,791,699 | B2 | 10/2017 | Chen | |
| 10,563,957 | B1 * | 2/2020 | Hamilton | F41G 1/35 |
| 2003/0090894 | A1 * | 5/2003 | Cummings | F41C 27/00 362/208 |

(Continued)

*Primary Examiner* — Jonathan C Weber
(74) *Attorney, Agent, or Firm* — Stinson LLP

(57) ABSTRACT

A firearm accessory and associated components and methods. In one embodiment, a firearm accessory is configured to mount to a shotgun. The firearm accessory is configured to emit light to illuminate a target. The firearm accessory includes an accessory body that is removable from the shotgun and permits convenient battery replacement.

64 Claims, 11 Drawing Sheets

(56) References Cited

U.S. PATENT DOCUMENTS

| | | | | |
|---|---|---|---|---|
| 2007/0039225 | A1 | 2/2007 | Kallio et al. | |
| 2010/0277896 | A1* | 11/2010 | Oehlkers | F41A 9/72 362/110 |
| 2011/0099876 | A1 | 5/2011 | Bentley | |
| 2012/0020063 | A1 | 1/2012 | Mironichev et al. | |
| 2012/0131840 | A1 | 5/2012 | Toole | |
| 2014/0007485 | A1 | 1/2014 | Castejon, Sr. | |
| 2018/0259286 | A1* | 9/2018 | Westcott | F41A 21/325 |
| 2020/0018449 | A1* | 1/2020 | Christensen | B29C 45/261 |

* cited by examiner

FIREARM ACCESSORY

CROSS-REFERENCE TO RELATED APPLICATIONS

The present application claims priority to U.S. Provisional Application No. 63/179,842, filed Apr. 26, 2021, the entirety of which is hereby incorporated by reference.

FIELD

The present disclosure generally relates to firearm accessories, such as an accessory for a shotgun and associated components and methods.

BACKGROUND

Various types of firearm accessories are known. For example, some types of accessories include firearm mountable lights and/or lasers. Improvements for shotgun firearm accessories and for other types of firearm arm accessories are needed.

SUMMARY

In one aspect, a firearm accessory is for a shotgun having a magazine tube. The firearm accessory comprises a magazine tube connector configured to connect to the magazine tube. The firearm accessory includes an accessory body releasably connectable to the magazine tube connector.

In another aspect, a firearm accessory is for a shotgun having a magazine tube. The firearm accessory comprises a magazine tube connector configured to connect to the magazine tube. The firearm accessory comprises a magazine insert configured to be received in the magazine tube. The magazine insert is connected to the magazine tube connector.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

The present disclosure is directed to an accessory 10 for a firearm F. In the illustrated embodiment, the firearm F is a shotgun, but it will be appreciated the accessory may be configured for use with other types of firearms, or other types of weapons.

Figure 1:
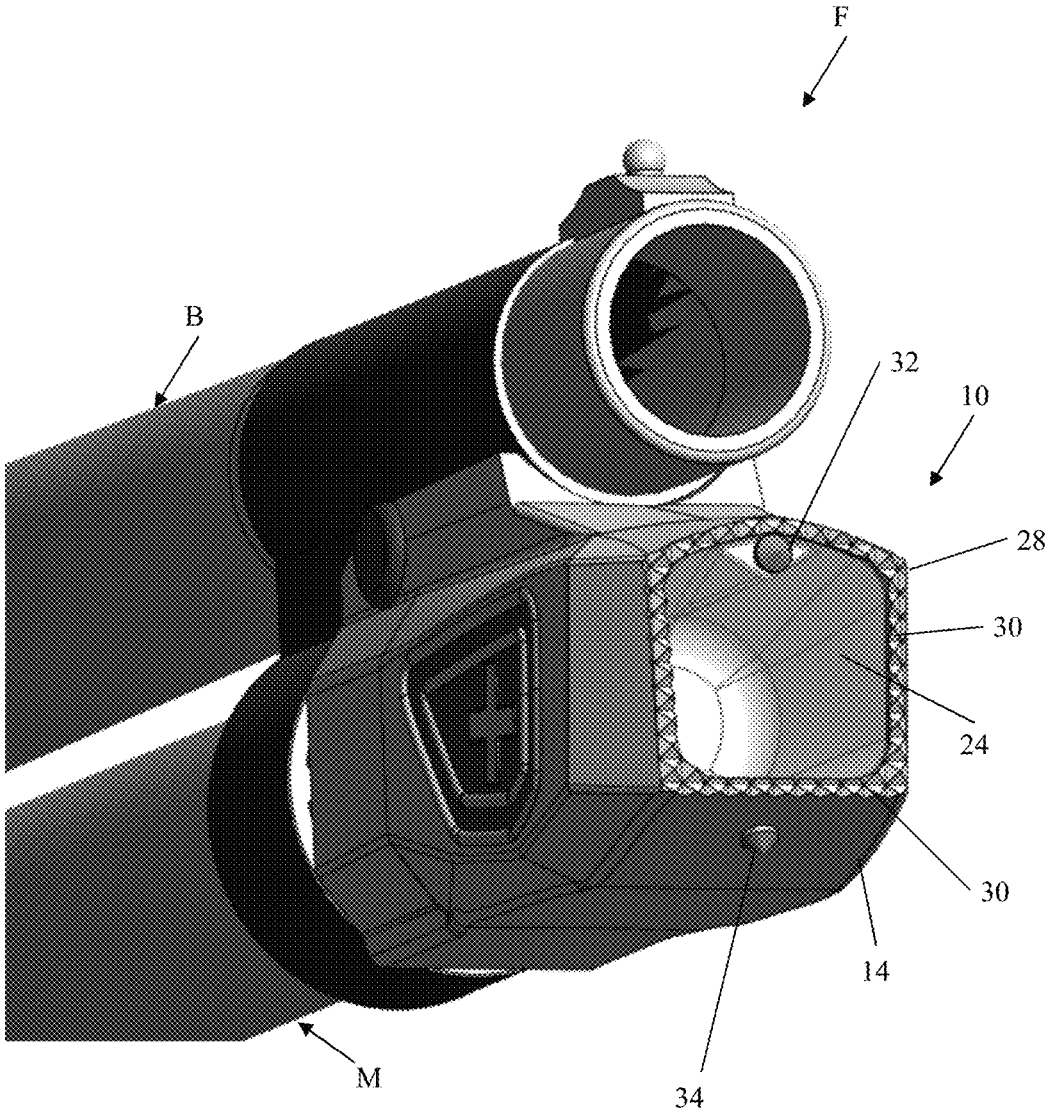
FIG. 1 is a right front perspective of a firearm accessory of the present disclosure on a shotgun.
Figure 2:
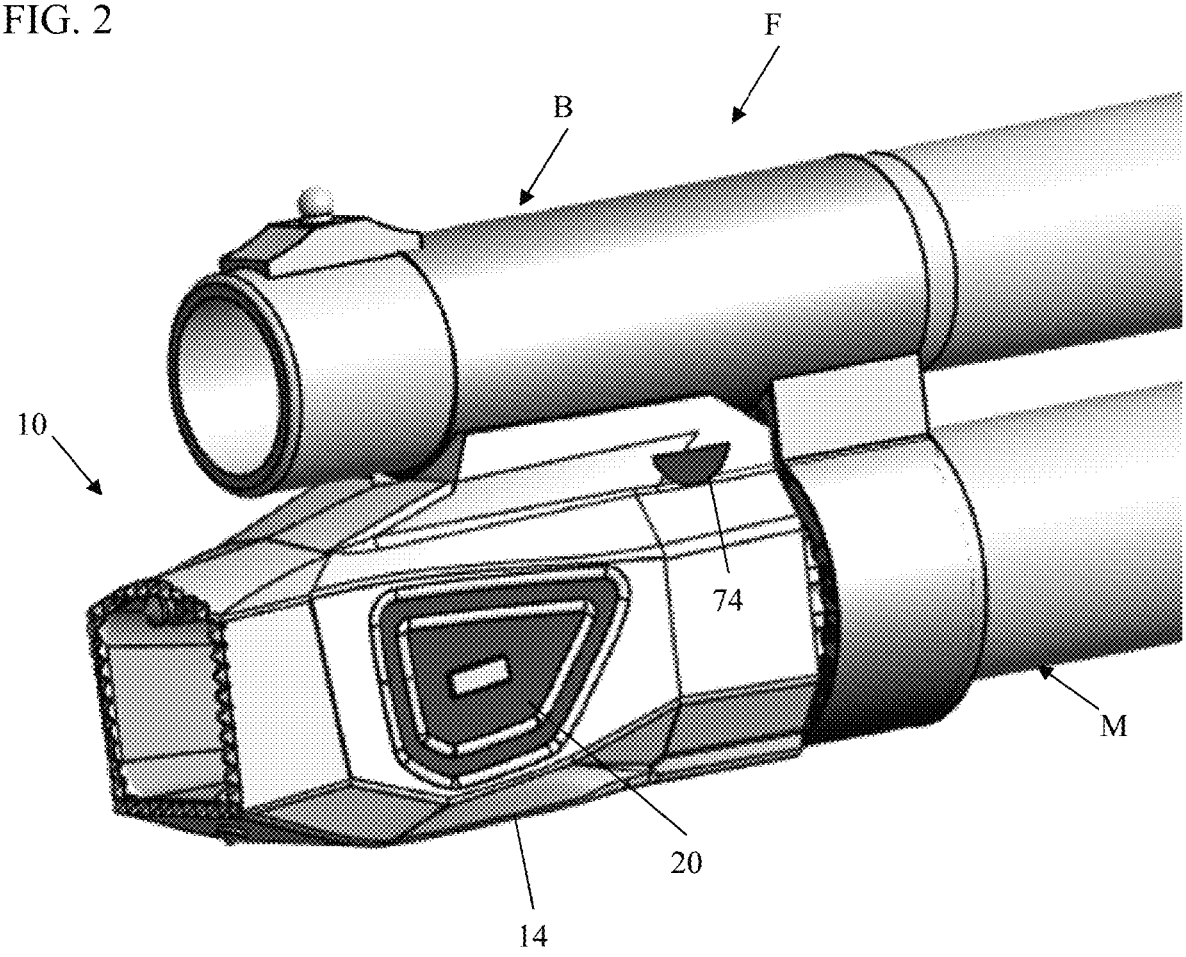
FIG. 2 is a left front perspective of the firearm accessory on the shotgun.
Figure 3:
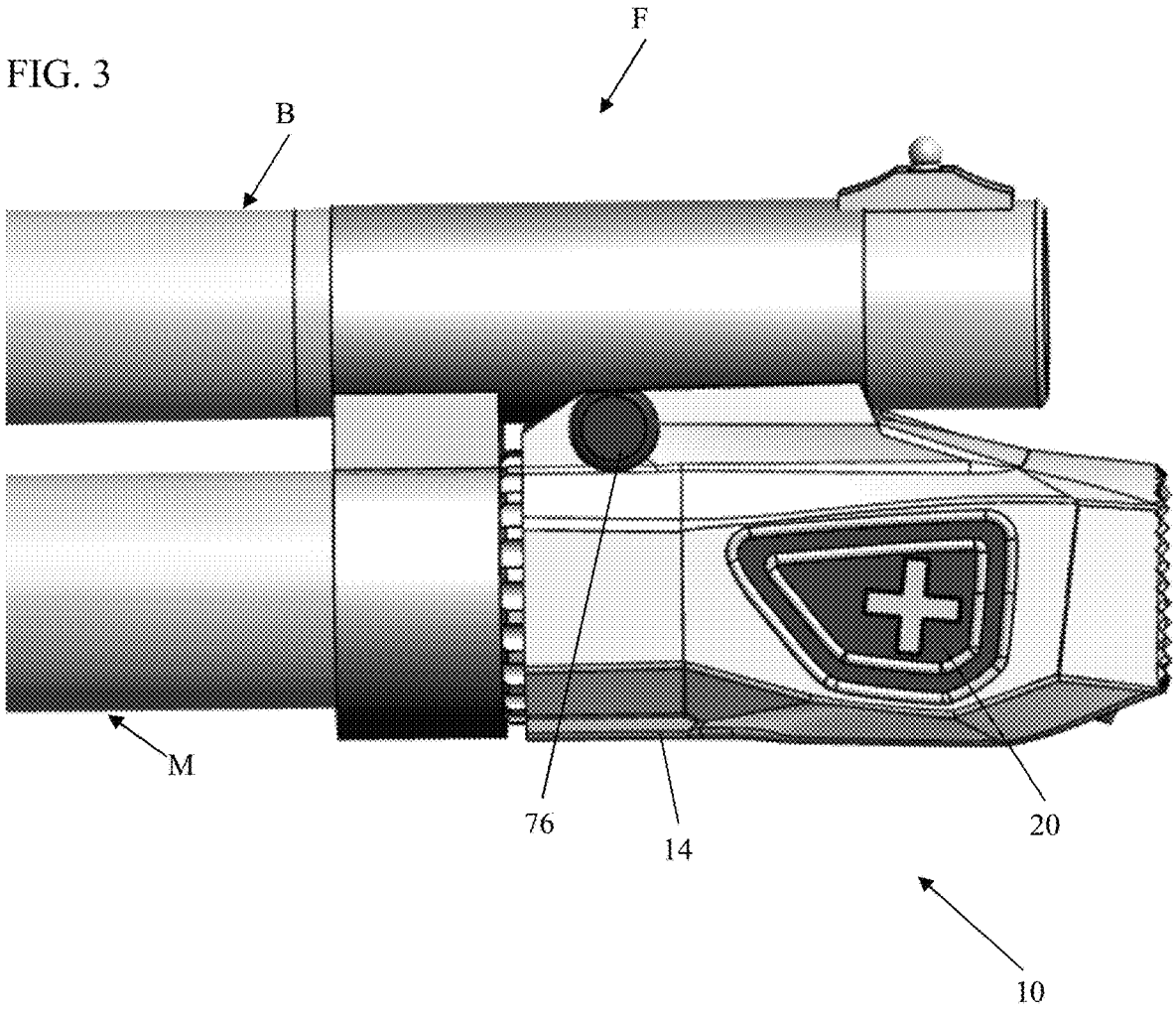
FIG. 3 is a right elevation of the firearm accessory on the shotgun.

Referring to FIGS. 1-3, a portion of a shotgun F is shown having the accessory 10 mounted thereon. In particular, distal ends of a shotgun barrel B and magazine M are shown. The shotgun F may include a bracket C connecting the barrel B and magazine M. The magazine M holds shotgun cartridges to be received into an action of the shotgun F to be fired by the shotgun. A cap (not shown) is provided by the shotgun manufacturer at the distal end of the magazine M to hold a spring in the magazine to bias cartridges in the magazine away from the distal end toward the action. The accessory 10 of the present disclosure is designed to be mountable on the shotgun F by removing the magazine cap and installing the accessory in its place on the distal end of the magazine M.

In the illustrated embodiment, the accessory 10 comprises a light (broadly, "illuminator"), but can also be referred to as a glass breaker. The accessory 10 could omit the light and/or glass breaking features without departing from the scope of the present disclosure. Moreover, the accessory could comprise a laser (broadly, "illuminator") in addition to or instead of the light and/or glass breaking features.

The accessory 10 includes an accessory body 14 (e.g., housing) defining an interior in which at least one LED 16 (FIG. 11) is received. The accessory body 14 has a front opening out of which light from the LED 16 is emitted when the LED is activated or energized. If a laser were provided, the laser may be arranged to emit a laser beam forward to illuminate a target in front of the shotgun.

Actuators 20 (e.g., plus, minus buttons) are provided on opposite sides of the accessory body 14. For example, the actuators 20 can comprise electronic switches under an external actuation cover having a press surface pressable by a finger of a user. The actuators 20 permit the user to turn the LED 16 on/off, to change between brightness levels (e.g., high, medium, low), and/or to change between modes (e.g., strobe, constant on). Actuators having other configurations can be used, or the actuators could be omitted, without departing from the scope of the present disclosure.

The accessory 10 includes a lens 24 covering the front opening to permit light from the LED 16 to emit from the accessory body 14 and prevent ingress of water or moisture. The lens 24 is non-circular and is surrounded by a non-circular bezel 28. Other shapes (e.g., circular) and sizes can be used.

The front face of the accessory includes a plurality of protrusions 30 on the bezel 28. The protrusions 30 are pointed and may be referred to as serrations. The protrusions 30 are arranged around the front opening. The protrusions 30 can serve as glass breaking protrusions or as a ram head for pushing an object or person in front of the barrel B.

The accessory 10 includes a first pointed glass breaking boss 32 extending forward in front of the plurality of protrusions 30. The boss 32 has a proximal end received in (e.g., threaded into) mounting structure behind the lens 24, has an intermediate portion extending through the lens, and includes a pointed forward portion extending in front of the lens. The arrangement is such that if the accessory is forced against a piece of glass with the front face leading, the pointed front end of the first boss 32 will contact and break the glass, followed by the plurality of protrusions 30.

The accessory 10 includes a second pointed glass breaking boss 34 extending downward from a lower surface of the accessory body 14. The boss 34 has a proximal end received in (e.g., threaded into) mounting structure of the accessory body 14, and includes a pointed lower portion extending downward from the accessory body. The pointed end of the second boss 34 faces downward and forward at a skew angle with respect to a longitudinal axis LA (FIG. 8) of the accessory (coincident with the longitudinal axis of the magazine tube TA). The arrangement is such that if the lower portion of the accessory body 14 is forced against a piece of glass, the pointed front end of the second boss 34 will contact and break the glass.

The protrusions 30, first boss 32, and/or second boss 34 can be omitted or have other configurations without departing from the scope of the present disclosure.

Figure 4:
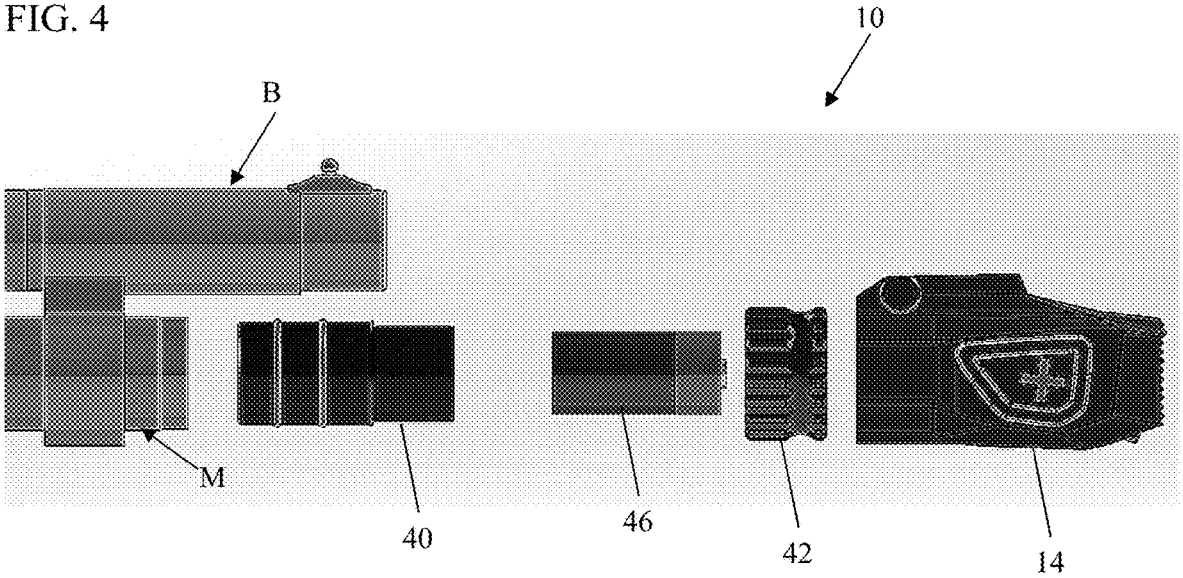
FIG. 4 is an exploded right elevation of the firearm accessory.
Figure 5:
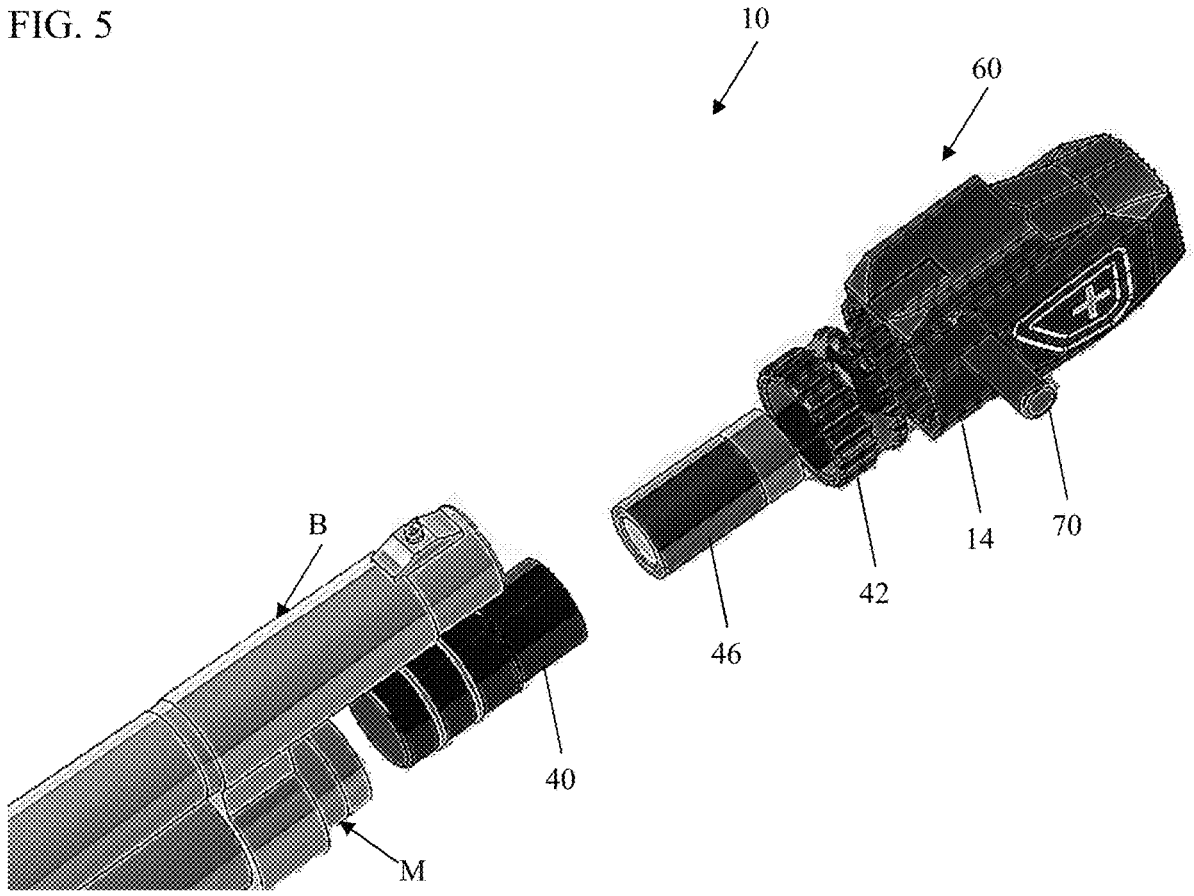
FIG. 5 is an exploded perspective of the firearm accessory.
Figure 8:
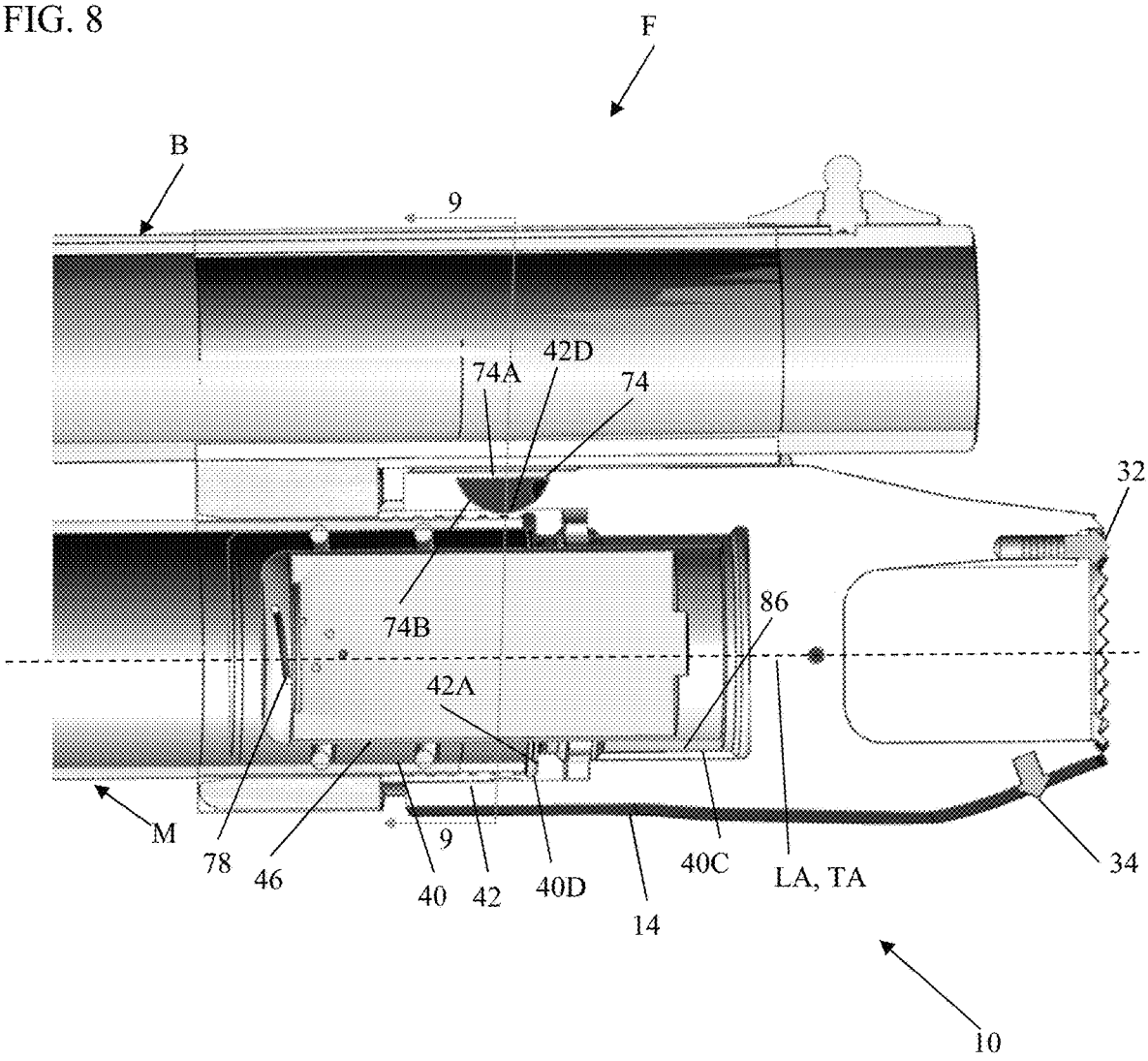
FIG. 8 is a section of the firearm accessory on the shotgun.

As shown in FIGS. 4, 5, and 8, the accessory 10 includes a magazine insert 40, a magazine connector 42 (broadly, firearm connection structure), and the accessory body 14. The magazine insert 40 is configured to be received in the distal end of the magazine M. The magazine insert 40 at least partially houses a battery 46 for supplying electrical power to the LED 16 and/or laser of the accessory. The magazine connector 42 is configured to be received over the distal end of the magazine tube M and to thread onto a male thread of the magazine tube (the thread intended by the shotgun manufacturer to connect the magazine cap). After insertion of the magazine insert 40 in the magazine tube M and threading of the magazine connector 42 onto the magazine tube, the accessory body 14 is installed over the magazine insert and connector.

Figure 6:
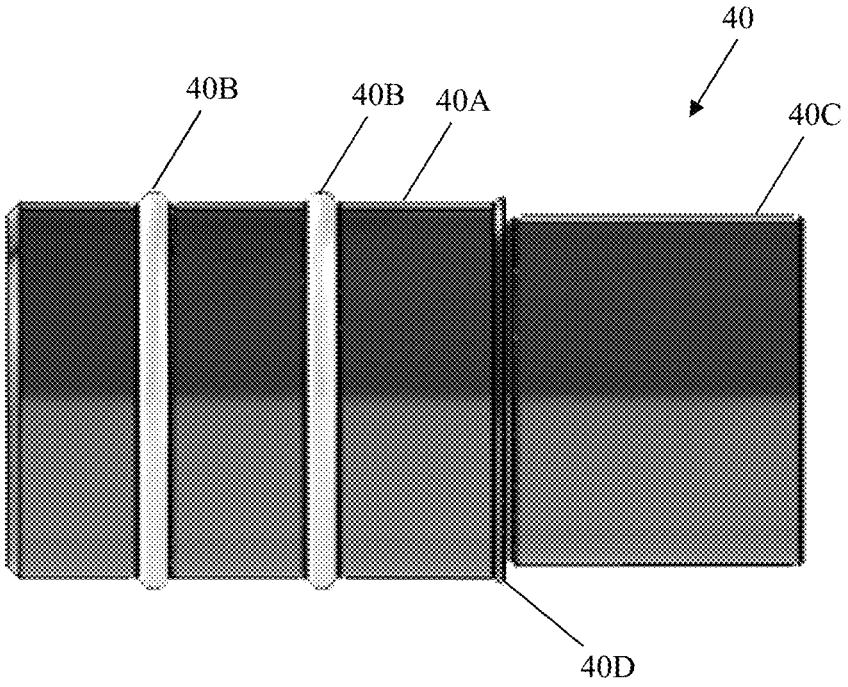
FIG. 6 is a right elevation of a magazine insert of the firearm accessory.

Referring to FIG. 6, the magazine insert 40 includes a generally cylindrical rear portion 40A having two resiliently compressible gaskets 40B (O-rings) thereon (in annular recesses of the rear portion) for contacting the inside surface of the magazine tube M. The magazine insert 40 includes a generally cylindrical forward portion 40C extending in front of the rear portion 40A for housing the battery 46 and for reception in the accessory body 14. The forward portion 40C has a smaller outer diameter than the rear portion 40A. The magazine insert 40 includes an annular shoulder 40D (broadly, lip) arranged to abut the distal end of the magazine tube M to limit rearward movement of the insert into the magazine tube. When the magazine connector 42 is threaded onto the magazine tube M, the connector may press the annular shoulder 40D against the distal end of the magazine tube. The rear end of the magazine insert 40 opposes the magazine spring when installed in the magazine tube so the magazine spring biases the shotgun cartridges toward the action of the shotgun.

Figure 7:
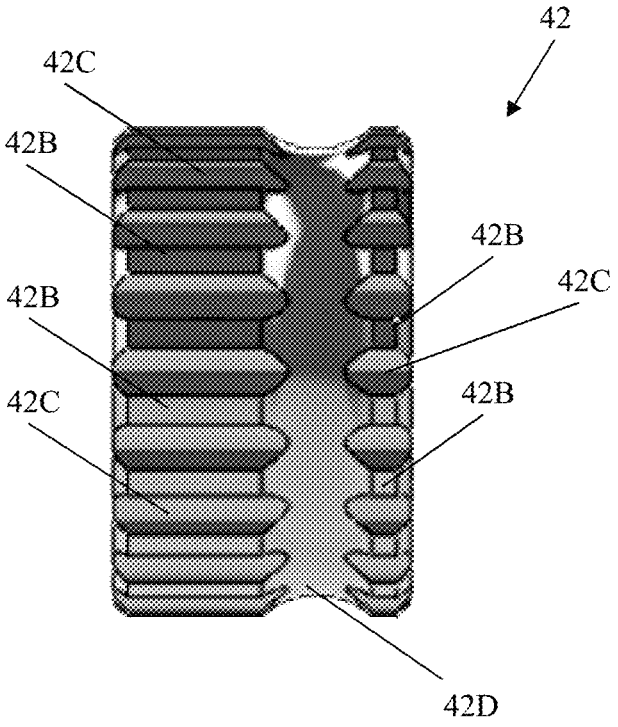
FIG. 7 is a right elevation of a magazine connector of the firearm accessory.

The magazine connector 42 may be referred to as a nut. The connector 42 includes an opening having a female thread adapted for threaded connection to the male thread of the magazine tube M. The connector 42 has an inner shoulder 42A (FIG. 8)) arranged for engagement with the annular shoulder 40D of the magazine insert 40 to push the shoulder toward the distal end of the magazine tube M. Referring to FIG. 7, the outer surface of the magazine connector 42 includes a plurality of ridges 42B spaced from each other by grooves 42C. The ridges/grooves 42B, 42C act as knurling that assists a user in gripping the connector 42 to rotate the connector to install and remove the connector by hand. The outer surface of the magazine connector 42 includes an annular recess 42D between rearward and forward rows of the ridges and grooves 42B, 42C. The annular recess 42D permits clearance for a fastener 50 for securing the accessory body 14 as explained in more detail below.

Figure 9:
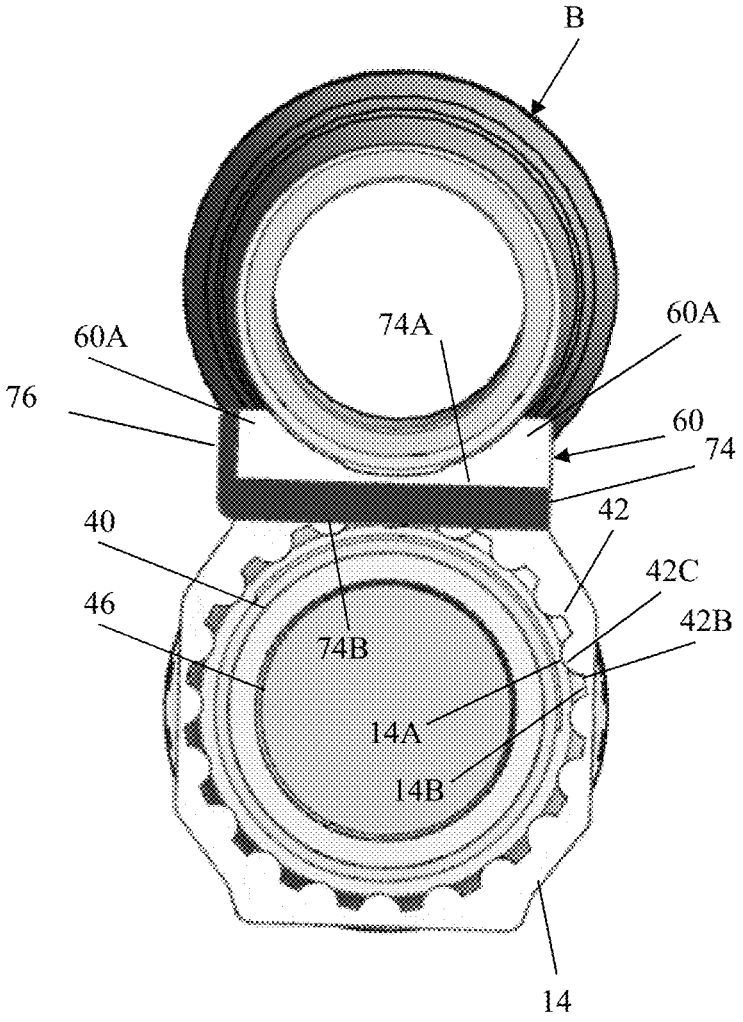
FIG. 9 is a section of the firearm accessory on the shotgun taken along a plane including line 9-9 of FIG. 8.
Figure 10:
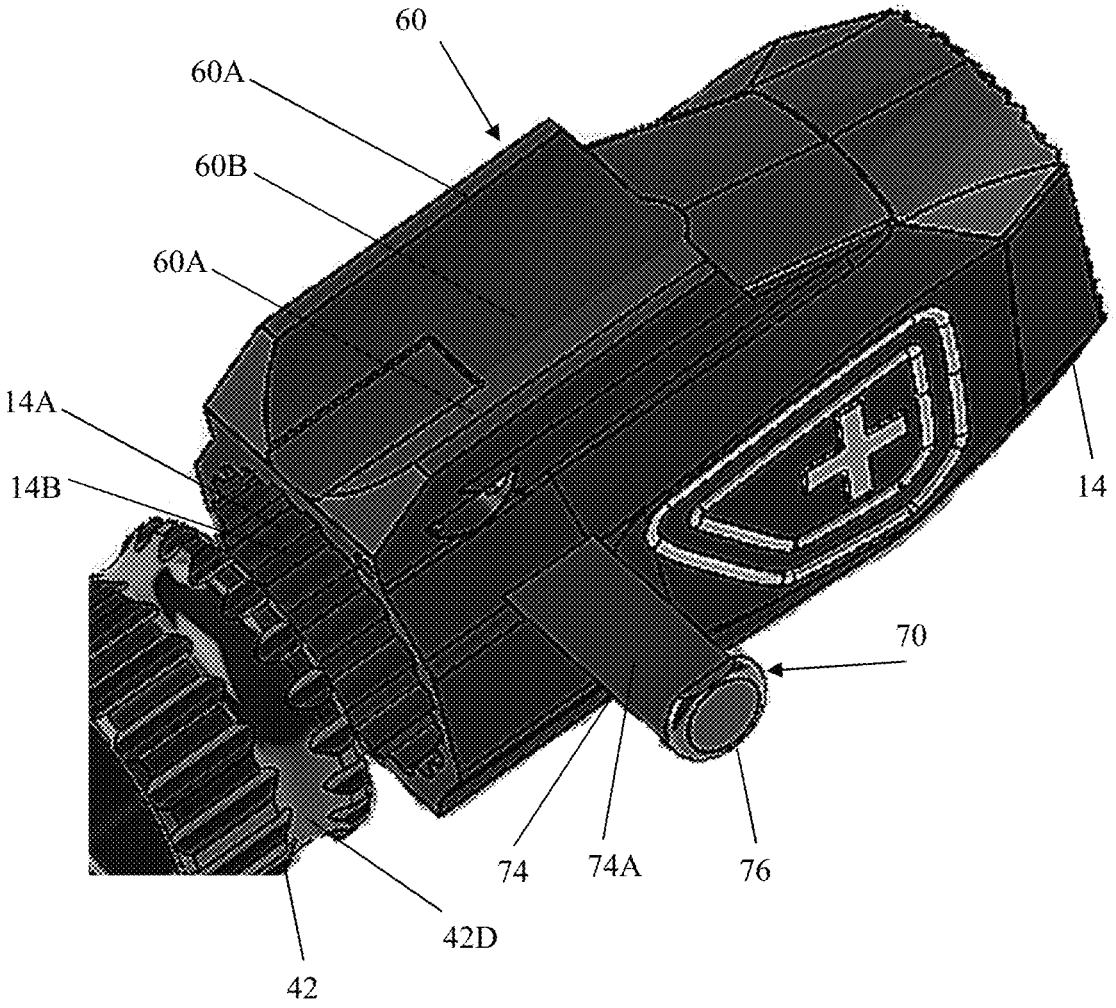
FIG. 10 is a fragmentary exploded right perspective of an accessory body, magazine connector, and fastener of the firearm accessory.

The accessory body 14 includes an opening sized and shaped for reception of the magazine connector 42 and the forward portion 40C of the magazine insert 40. As shown in FIGS. 9 and 10, the accessory body 14 has internal ridges 14A and grooves 14B. The ridges 14A are configured to mesh with the ridges 42B of the magazine connector 42. Meshing of the ridges limits rotation of the accessory body 14 with respect to the magazine connector 42 and vice versa.

Figure 11:
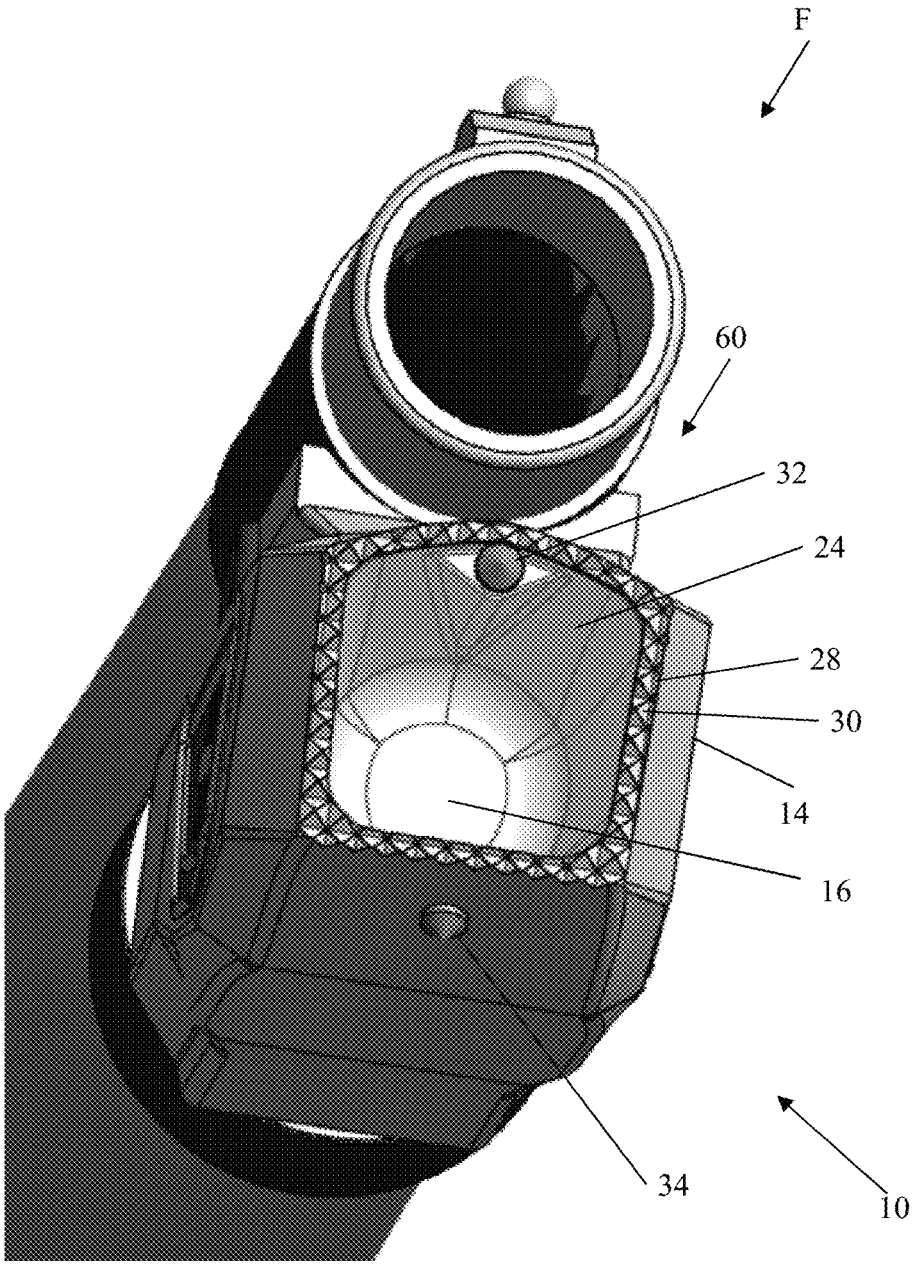
FIG. 11 is a front bottom perspective of the firearm accessory on the shotgun.

Referring to FIGS. 9-11, the accessory body 14 defines a barrel brace 60 arranged to straddle the barrel B when the accessory body is installed on the shotgun F. The barrel brace 60 includes opposing flanges 60A or ribs and an arcuate recess 60B between the flanges. The arrangement is such that when the accessory body 14 is installed the barrel B is received in the arcuate recess 60B and the flanges 60A straddle the bottom side of the barrel. The engagement of the brace 60 with the barrel B limits rotation of the accessory body 14 about the longitudinal axis MA of the magazine tube to maintain the upright orientation of the accessory body.

After the magazine connector 42 is installed on the magazine tube M, the accessory body 14 is installed by moving the accessory body rearward onto the magazine connector 42, which causes the ridges 42B of the magazine connector to become meshed with the ridges 14A of the accessory body. As shown in FIG. 10, to maintain the accessory body 14 on the magazine connector 42, a fastener 70 is installed laterally into a laterally extending opening 72 in the accessory body. The fastener 70 comprises a shaft 74 having a flat upper surface 74A and an arcuate lower surface 74B. The arcuate lower surface 74B is sized and shaped to correspond to the annular arcuate recess 42D in the magazine connector 42. Referring to FIGS. 8 and 9, reception of the shaft 74 in the annular arcuate recess 42D prevents the accessory body 14 from moving forward off the magazine connector 42. The fastener 70 includes a head 76 that engages the side of the accessory body 14 to locate the shaft 74 in the accessory body. The fastener 70 may be retained by friction fit with the accessory body 14 or in another suitable way (e.g., detent, releasable latch, etc.).

To remove the accessory body 14 (e.g., to replace the battery 46), the fastener 70 is pulled out (e.g., by pulling the head 76), and the accessory body 14 can be pulled forward off the magazine connector 42. Notably, the accessory body 14 can be pulled forward without needing to unscrew the accessory body or the magazine connector 42 from the shotgun F, and this exposes the battery 46 for convenient removal/replacement. A spring 78 (FIG. 8) in the magazine insert 40 behind the battery 46 biases the battery forward. The spring 78 can serve as a negative electrical contact for contacting the negative terminal of the battery 46. The positive terminal of the battery is biased forward by the spring 78 for contacting a positive electrical contact carried by the accessory body 14.

As shown in FIG. 8, the forward portion 40C of the magazine insert 40 extends forward into a reduced diameter portion 86 of the accessory body 14 (friction fit) for forming a seal to limit ingress of liquid into the battery compartment. A resiliently compressible gasket (e.g., O-ring) could be provided in the accessory body 14 to be compressed between the forward end of the magazine connector 42 and a rearward facing shoulder and/or to be compressed between the forward end of the magazine insert 40 and the accessory body 14.

It will be appreciated that the magazine insert 40 and accessory body 14 collectively define a battery housing, with the battery at least partially housed in the magazine tube M of the shotgun F. Moreover, it will be appreciated that the magazine insert 40 and magazine connector 42 can be referred to as a magazine tube mount to which the accessory body 14 is releasably connectable.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

It will be apparent that modifications and variations are possible without departing from the scope of the invention defined in the appended claims. The dimensions and proportions described herein are by way of example without limitation. Other dimensions and proportions can be used without departing from the scope of the present disclosure.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A firearm accessory for a shotgun having a magazine tube, the firearm accessory comprising:

a magazine tube mount configured to mount to the magazine tube, the magazine tube mount including a magazine tube insert configured to be received in the magazine tube when the magazine tube mount is mounted to the magazine tube; and an accessory body carrying a light source, the accessory body when carrying the light source being releasably connectable to the magazine tube mount when the magazine tube mount is mounted to the magazine tube to mount the light source to the magazine tube mount, the accessory body being configured to hold the light source in a first position relative to the accessory body when the accessory body is releasably connected to the magazine tube mount and to hold the light source in the first position relative to the accessory body when the accessory body is disconnected from the magazine tube mount, the accessory body including an opening configured to receive the magazine tube mount when the accessory body is releasably connected to the magazine tube mount.

2. The firearm accessory of claim 1, wherein the light source is arranged to emit light in a forward direction when the magazine tube mount is connected to the magazine tube and the accessory body is connected to the magazine tube mount.

3. The firearm accessory of claim 2, wherein the magazine tube mount at least partially defines a receiving space configured to receive a power source for powering the light source.

4. The firearm accessory of claim 3, further comprising a button operatively connected to the light source and configured to selectively turn the light source on or off.

5. The firearm accessory of claim 4, wherein the button is carried by the accessory body.

6. The firearm accessory of claim 2, wherein the accessory body includes a lens in front of the light source through which the light source is configured to emit light in the forward direction.

7. The firearm accessory of claim 1, wherein the magazine tube mount comprises a magazine tube connector including threading configured to threadably engage threading of the magazine tube to connect the magazine tube mount to the magazine tube.

8. The firearm accessory of claim 7, wherein the opening of the accessory body is sized and shaped to receive the magazine tube connector for releasably connecting the accessory body to the magazine tube mount.

9. The firearm accessory of claim 8, further comprising a retainer configured to secure the accessory body to the magazine tube mount when the accessory body is releasably connected to the magazine tube mount.

10. The firearm accessory of claim 9, wherein the accessory body is releasably connectable to the magazine tube connector to releasably connect the accessory body to the magazine tube mount.

11. The firearm accessory of claim 10, wherein the retainer comprises a pin.

12. The firearm accessory of claim 10, wherein the accessory body or the magazine tube mount includes a projection and the other of the accessory body or the magazine tube mount includes a recess, the projection and the recess being sized, shaped, and arranged relative to one another such that the recess receives the projection when the accessory body is releasably connected to the magazine tube mount to inhibit the accessory body from rotating relative to the magazine tube mount.

13. The firearm accessory of claim 8, wherein the opening of the accessory body is sized and shaped to receive a portion of the magazine tube insert extending out of the magazine tube when the magazine tube mount is mounted to the magazine tube and the accessory body is releasably connected to the magazine tube mount.

14. The firearm accessory of claim 13, wherein the opening of the accessory body is sized and shaped to receive a portion of the magazine tube when the magazine tube mount is mounted to the magazine tube and the accessory body is releasably connected to the magazine tube mount.

15. The firearm accessory of claim 1, wherein the accessory body or the magazine tube mount includes a projection and the other of the accessory body or the magazine tube mount includes a recess, the projection and the recess being sized, shaped, and arranged relative to one another such that the recess receives the projection when the accessory body is releasably connected to the magazine tube mount to inhibit the accessory body from rotating relative to the magazine tube mount.

16. The firearm accessory of claim 1, wherein the magazine tube mount includes a magazine tube connector, the accessory body being releasably connectable to the magazine tube connector to releasably connect the accessory body to the magazine tube mount.

17. The firearm accessory of claim 16, wherein the magazine tube connector is configured to retain the magazine tube insert in the magazine tube when the magazine tube connector is connected to the magazine tube.

18. The firearm accessory of claim 1, further comprising a glass breaking boss carried by the accessory body, the glass breaking boss being proud with respect to the accessory body and configured to contact glass and break the glass when the accessory body is forced toward the glass.

19. The firearm accessory of claim 1, wherein the magazine tube insert includes a shoulder arranged to engage an end of the magazine tube to limit insertion of the magazine tube insertion into the magazine tube.

20. The firearm accessory of claim 1, wherein the magazine tube mount comprises a magazine tube connector configured to connect to the magazine tube and configured to compress the magazine tube insert against an end of the magazine tube to secure the magazine tube insert in the magazine tube, the magazine tube connector being configured to be removable from the magazine tube separately from the magazine tube insert.

21. The firearm accessory of claim 1, wherein the opening of the accessory body is sized and shaped to receive a portion of the magazine tube insert extending out of the magazine tube when the magazine tube mount is mounted to the magazine tube and the accessory body is releasably connected to the magazine tube mount.

22. The firearm accessory of claim 1, wherein the magazine tube mount includes a gasket configured to engage an inside surface of the magazine tube when the magazine tube insert is received in the magazine tube.

23. The firearm accessory of claim 1, wherein the light source is secured to the accessory body to be held in the first position relative to the accessory body when the accessory body is disconnected from the magazine tube mount.

24. The firearm accessory of claim 1, wherein the light source is connected to the accessory body to be held in the first position relative to the accessory body, notwithstanding an orientation of the accessory body, when the accessory body is disconnected from the magazine tube mount.

25. A firearm accessory for a shotgun having a magazine tube, the firearm accessory comprising:

a magazine tube mount configured to mount to the magazine tube, the magazine tube mount including a magazine tube insert configured to be received in the magazine tube when the magazine tube mount is mounted to the magazine tube; and an accessory body carrying a light source, the accessory body when carrying the light source being releasably connectable to the magazine tube mount when the magazine tube mount is mounted to the magazine tube to mount the light source to the magazine tube mount, wherein the accessory body or the magazine tube mount includes a projection and the other of the accessory body or the magazine tube mount includes a recess, the projection and the recess being sized, shaped, and arranged relative to one another such that the recess receives the projection when the accessory body is releasably connected to the magazine tube mount to inhibit the accessory body from rotating relative to the magazine tube mount.

26. The firearm accessory of claim 25, wherein the accessory body includes the projection and the magazine tube mount includes the recess.

27. The firearm accessory of claim 25, wherein the accessory body includes the recess and the magazine tube mount includes the projection.

28. The firearm accessory of claim 25, wherein the projection is a first projection and the recess is a first recess, and wherein the accessory body or the magazine tube mount includes a second projection and the other of the accessory body or the magazine tube mount includes a second recess, the second projection and the second recess being sized, shaped, and arranged relative to one another such that the second recess receives the second projection when the accessory body is releasably connected to the magazine tube mount to inhibit the accessory body from rotating relative to the magazine tube mount.

29. The firearm accessory of claim 28, wherein the accessory body includes the first and second projections and the magazine tube mount includes the first and second recesses.

30. The firearm accessory of claim 28, wherein the accessory body includes the first and second recesses and the magazine tube mount includes the first and second projections.

31. The firearm accessory of claim 25, wherein the accessory body includes the first projection and the second recess and the magazine tube mount includes the second projection and the first recess.

32. The firearm accessory of claim 25, wherein the accessory body includes an opening configured to receive the magazine tube mount when the accessory body is releasably connected to the magazine tube mount, the projection or recess of the accessory body being disposed within the opening.

33. The firearm accessory of claim 32, wherein the magazine tube mount comprises a magazine tube connector including threading configured to threadably engage threading of the magazine tube to connect the magazine tube mount to the magazine tube, the magazine tube connector being configured to retain the magazine tube insert in the magazine tube when the magazine tube connector is connected to the magazine tube, the magazine tube connector including the projection or recess of the magazine tube mount.

34. A firearm accessory for a shotgun having a magazine tube, the firearm accessory comprising:

a magazine tube mount configured to mount to the magazine tube, the magazine tube mount including a magazine tube insert configured to be received in the magazine tube when the magazine tube mount is mounted to the magazine tube, the magazine tube mount including a magazine tube connector configured to connect to the magazine tube and configured to press the magazine tube insert against an end of the magazine tube to secure the magazine tube insert in the magazine tube, the magazine tube connector being configured to be removable from the magazine tube separately from the magazine tube insert; and an accessory body carrying a light source, the accessory body when carrying the light source being releasably connectable to the magazine tube mount when the magazine tube mount is mounted to the magazine tube to mount the light source to the magazine tube mount.

35. The firearm accessory of claim 34, wherein the magazine tube insert includes a shoulder arranged to engage an end of the magazine tube to limit insertion of the magazine tube insertion into the magazine tube.

36. The firearm accessory of claim 35, wherein the magazine tube connector includes a shoulder arranged to push the shoulder of the magazine tube insert toward the end of the magazine tube.

37. The firearm accessory of claim 34, wherein the magazine tube connector includes threading configured to threadably engage threading of the magazine tube to connect the magazine tube mount to the magazine tube.

38. The firearm accessory of claim 37, wherein the accessory body includes an opening configured to receive the magazine tube connector when the accessory body is releasably connected to the magazine tube mount.

39. The firearm accessory of claim 38, wherein the opening of the accessory body is sized and shaped to receive a portion of the magazine tube insert extending out of the magazine tube when the magazine tube mount is mounted to the magazine tube and the accessory body is releasably connected to the magazine tube mount.

40. A firearm accessory for a shotgun having a magazine tube, the firearm accessory comprising:

a magazine tube mount configured to mount to the magazine tube, the magazine tube mount including a magazine tube insert configured to be received in the magazine tube when the magazine tube mount is mounted to the magazine tube, the magazine tube mount including a gasket configured to engage an inside surface of the magazine tube when the magazine tube insert is received in the magazine tube; and an accessory body carrying a light source, the accessory body when carrying the light source being releasably connectable to the magazine tube mount when the magazine tube mount is mounted to the magazine tube to mount the light source to the magazine tube mount.

41. The firearm accessory of claim 40, wherein the gasket is carried by the magazine tube insert.

42. The firearm accessory of claim 41, wherein the gasket encircles the magazine tube insert.

43. The firearm accessory of claim 42, wherein the gasket comprises and O-ring.

44. The firearm accessory of claim 40, wherein the gasket is a first gasket, wherein the magazine tube mount includes a second gasket configured to engage the inside surface of the magazine tube when the magazine tube insert is received in the magazine tube.

45. The firearm accessory of claim 40, wherein the gasket is a first gasket, and wherein the firearm accessory includes a second gasket configured to be compressed between the magazine tube mount and the accessory body.

46. A firearm accessory for a shotgun having a magazine tube, the firearm accessory comprising:

a magazine tube mount configured to mount to the magazine tube, the magazine tube mount including a magazine tube insert configured to be received in the magazine tube when the magazine tube mount is mounted to the magazine tube; and an accessory body carrying a light source, the accessory body when carrying the light source being releasably connectable to the magazine tube mount when the magazine tube mount is mounted to the magazine tube to mount the light source to the magazine tube mount;

the magazine tube mount including first connection structure and the accessory body including second connection structure, the first and second connection structure being configured to engage one another when the accessory body is connected to the magazine tube mount, the first and second connection structure configured to define at least two preset orientations for the accessory body relative to the magazine tube mount when the accessory body is connected to the magazine tube mount.

47. The firearm accessory of claim 46, wherein the at least two preset orientations are different rotational positions of the accessory body about a longitudinal axis of the magazine tube.

48. The firearm accessory of claim 46, wherein the first and second connection structures are configured to inhibit the accessory body from rotating relative to the magazine tube mount about a longitudinal axis of the magazine tube when the accessory body is connected to the magazine tube mount.

49. The firearm accessory of claim 48, wherein the first connection structure or the second connection structure includes a projection and the other of the first connection structure or second connection structures includes a recess, the projection and the recess being sized, shaped, and arranged relative to one another such that the recess receives the projection when the accessory body is releasably connected to the magazine tube mount to inhibit the accessory body from rotating relative to the magazine tube mount.

50. The firearm accessory of claim 46, wherein the first connection structure of the second connection structure includes a projection and the other of the first connection structure or second connection structure includes a first recess and a second recess, the projection and the first recess being sized, shaped, and arranged relative to one another such that the first recess receives the projection when the accessory body is in a first preset orientation of the at least two preset orientations relative to the magazine tube mount and is releasably connected to the magazine tube mount, and the projection and the second recess being sized, shaped, and arranged relative to one another such that the second recess receives the projection when the accessory body is in a second preset orientation of the at least two preset orientations relative to the magazine tube mount and is releasably connected to the magazine tube mount.

51. A firearm accessory for a shotgun having a magazine tube, the firearm accessory comprising:

a magazine tube mount configured to mount to the magazine tube, the magazine tube mount including a magazine tube insert configured to be received in the magazine tube when the magazine tube mount is mounted to the magazine tube, the magazine tube mount including a magazine tube connector having threading configured to threadably engage threading of the magazine tube to connect the magazine tube mount to the magazine tube; and an accessory body carrying a light source, the accessory body when carrying the light source being releasably connectable to the magazine tube mount when the magazine tube mount is mounted to the magazine tube to mount the light source to the magazine tube mount, the accessory body being configured to be connected to the magazine tube mount, when the magazine tube mount is mounted to the magazine tube, independent of movement of the magazine tube connector with respect to the magazine tube.

52. The firearm accessory of claim 51, wherein the accessory body includes an opening configured to receive the magazine tube mount when the accessory body is releasably connected to the magazine tube mount.

53. The firearm accessory of claim 52, wherein the opening of the accessory body is sized and shaped to receive the magazine tube connector for releasably connecting the accessory body to the magazine tube mount.

54. The firearm accessory of claim 53, wherein the opening of the accessory body is sized and shaped to receive a portion of the magazine tube insert extending out of the magazine tube when the magazine tube mount is mounted to the magazine tube and the accessory body is releasably connected to the magazine tube mount.

55. The firearm accessory of claim 52, wherein the opening of the accessory body is sized and shaped to receive a portion of the magazine tube insert extending out of the magazine tube when the magazine tube mount is mounted to the magazine tube and the accessory body is releasably connected to the magazine tube mount.

56. The firearm accessory of claim 51, further comprising a retainer configured to secure the accessory body to the magazine tube mount when the accessory body is releasably connected to the magazine tube mount.

57. The firearm accessory of claim 56, wherein the retainer is configured to engage the magazine tube connector to secure the accessory body to the magazine tube mount.

58. A firearm accessory for a shotgun having a magazine tube, the firearm accessory comprising:

a magazine tube mount configured to mount to the magazine tube, the magazine tube mount including a magazine tube insert configured to be received in the magazine tube when the magazine tube mount is mounted to the magazine tube; and an accessory body carrying a light source, the accessory body when carrying the light source being releasably connectable to the magazine tube mount when the magazine tube mount is mounted to the magazine tube to mount the light source to the magazine tube mount;

the magazine tube mount having a battery receiving space configured to receive a battery for powering the light source, the accessory body including an opening configured to receive the battery when the accessory body is releasably connected to the magazine tube mount, the magazine tube mount configured to locate the battery to be in electrical communication with the accessory body when the accessory body is releasably connected to the magazine tube mount.

59. The firearm accessory of claim 58, wherein the magazine tube insert includes the battery receiving space.

60. The firearm accessory of claim 59, wherein the opening of the accessory body is sized and shaped to receive a portion of the magazine tube insert extending out of the magazine tube when the magazine tube mount is mounted to the magazine tube and the accessory body is releasably connected to the magazine tube mount.

61. The firearm accessory of claim 58, wherein the magazine tube mount includes a spring configured to bias the battery into electrical communication with the accessory body when the accessory body is releasably connected to the magazine tube mount.

62. The firearm accessory of claim 61, wherein the spring is carried by the magazine tube insert.

63. The firearm accessory of claim 58, wherein the magazine tube mount is configured to receive the battery in the battery receiving space independent of the connection of the accessory body to the magazine tube mount.

64. The firearm accessory of claim 58, wherein the accessory body is disconnectable from the magazine tube mount without removal of the battery from the battery receiving space.

* * * * *